United States Patent [19]

Tsujimoto

[11] Patent Number: 4,868,483

[45] Date of Patent: Sep. 19, 1989

[54] POWER VOLTAGE REGULATOR CIRCUIT

[75] Inventor: Jun-ichi Tsujimoto, Yokohama, Japan

[73] Assignee: Kabushiki Kaisha Toshiba, Kawasaki, Japan

[21] Appl. No.: 55,548

[22] Filed: May 29, 1987

[30] Foreign Application Priority Data

May 31, 1986 [JP] Japan ..... 61-126339

[51] Int. Cl.[4] ..... G05F 3/16

[52] U.S. Cl. ..... 323/313; 323/281

[58] Field of Search ..... 323/275, 281, 303, 313

[56] References Cited

U.S. PATENT DOCUMENTS

| | | | |
|---|---|---|---|
| 4,283,674 | 8/1981 | Kominami et al. | 323/313 |
| 4,585,955 | 4/1986 | Uchida | 307/297 |
| 4,593,338 | 6/1986 | Takeda et al. | 323/275 |
| 4,608,529 | 8/1986 | Mallinson | 323/303 |
| 4,649,291 | 3/1987 | Konishi | 307/297 |

FOREIGN PATENT DOCUMENTS

| | | |
|---|---|---|
| 0113458 | 7/1984 | European Pat. Off. . |
| 0152805 | 8/1985 | European Pat. Off. . |
| 0214899 | 3/1987 | European Pat. Off. . |

*Primary Examiner*—Patrick R. Salce
*Assistant Examiner*—Jeffrey Sterrett
*Attorney, Agent, or Firm*—Finnegan, Henderson, Farabow, Garrett, & Dunner

[57] ABSTRACT

A power voltage regulator circuit has a power terminal to which an external power voltage is supplied, an output line, and a voltage-drop circuit connected between the power terminal and the output line. The voltage drop circuit includes an N-channel MOS transistor having a drain connected to the power terminal and a source connected to the output line, a constant voltage generator for supplying a voltage, lower than the external power voltage, to a gate of the MOS transistor, and a semiconductor well whose surface area serves as a channel region of the MOS transistor.

13 Claims, 3 Drawing Sheets

POWER VOLTAGE REGULATOR CIRCUIT

BACKGROUND OF THE INVENTION

The present invention relates to a power voltage regulator circuit for lowering a power voltage, which is supplied from the outside, as an internal power source within a semiconductor integrated circuit (IC) device.

The integration density of a semiconductor IC device has recently been increased with rapidity. For example, in a large-scale integrated (LSI) memory device, MOS transistors having a gate length of a submicron order are employed to form a memory unit. Submicron MOS transistors are prone to be adversely affected in a high electric field, and, therefore, they need to be operated with a power voltage lower than 5 V, which is generally employed in a computer system. A power voltage regulator circuit is formed within a single semiconductor chip along with a memory unit, in order to provide a power voltage of a predetermined level.

FIG. 1 shows conventional power voltage regulator circuit 10. Load circuit 12 is an integrated circuit, for example, a memory unit, and is operated with internal power voltage VI produced from regulator circuit 10. Regulator circuit 10 includes P-channel MOS transistor 14, which serves as a variable resistor, and differential amplifier 16 for controlling a gate voltage of MOS transistor 14. The source of MOS transistor 14 is connected to power terminal VDD to which an external power voltage is supplied. The drain of MOS transistor 14 serves as an output terminal of regulator circuit 10, from which internal power voltage VI is produced. Load circuit 12 is connected between the drain of MOS transistor 14 and power terminal VSS set to the ground potential. The source of MOS transistor 14 is electrically connected to a back gate, that is, a semiconductor region having a surface area which serves as a channel of MOS transistor 14, so that the semiconductor region is set to a potential equal to that of power terminal VDD.

Differential amplifier 16 comprises N-channel MOS transistors 18 and 20 constituting a differential pair, N-channel MOS transistor 22 serving as a constant voltage source, and P-channel MOS transistors 24 and 26 constituting a current mirror load. Resistor elements R1 and R2 are connected in series between power terminals VDD and VSS, thereby to form a voltage divider that generates reference voltage VR. Reference voltage VR is supplied to the gate of MOS transistor 18, and an output voltage of regulator circuit 10, or internal power voltage VI, is fed to the gate of MOS transistor 20. When a current flows through load circuit 12, a voltage drop occurs in MOS transistor 14, and internal power voltage VI is made lower than the external power voltage. Differential amplifier 16 compares internal power voltage VI and reference voltage VR, and controls the gate of MOS transistor 14 so as to reduce the difference between voltages VI and VR.

Regulator circuit 10 is, however, not suitable for an LSI device of the type which is required to be operated with a small power consumption. In the design of a static-type random access memory (SRAM), there is a case in which the power consumption is limited to 50 mA or less. Differential amplifier 16 of a current-mirror type consumes relatively large amount of current, that is, about 5–6 mA. Therefore, it is difficult to satisfy the requirement of the power consumption, without degrading the characteristics of the SRAM.

SUMMARY OF THE INVENTION

It is an object of the present invention to provide a power voltage regulator circuit whose power consumption is small.

According to the present invention, there is provided a power voltage regulator circuit comprising a power terminal for receiving an external power voltage, an output line, an N-channel metal insulator semiconductor (MIS) transistor, having a drain connected to the power terminal, a source connected to the output line, and a gate, and serving as a voltage drop element for lowering the external power voltage; a semiconductor body whose surface region serves as a channel of the MIS transistor, the semiconductor body being connected such that the semiconductor body has a potential equal to that of the source of the MIS transistor, and a constant voltage generator connected to receive the external power voltage, for generating a constant voltage lower than the external power voltage when the external power voltage is higher than a predetermined level, and for supplying this constant voltage to the insulated gate of the MIS transistor.

In this invention, when the external power voltage is set to a value higher than a predetermined value, a constant voltage lower than the external power voltage is fed to the gate of the MIS transistor from the constant voltage generator. When a load current flows, a voltage drop occurs in the MIS transistor, and the potential of the output line is set to a level lower than the gate voltage by the amount of the threshold voltage of the MIS transistor. In the case where the potential of the semiconductor body is equalized to that of the source of the MIS transistor, as mentioned above, the variation in the threshold voltage due to the backgate bias effect can be prevented. Further, if the increase in the load current results in the decrease in the potential of the output line, the potential of the semiconductor body varies in accordance with the decrease in the potential of the output line, to increase the conductivity of the MIS transistor. In other words, the decrease in the potential of the output line is automatically compensated. In the present invention, there is no need to set the operation current of the constant voltage generator to such a high level as is employed in the conventional current mirror type differential amplifier wherein the gate voltage of the MIS transistor is controlled with reference to the potential of the output line. The power consumption of the power voltage regulator circuit can be reduced.

DETAILED DESCRIPTION OF THE PREFERRED EMBODIMENT

A power voltage regulator circuit according to an embodiment of the invention will now be described with reference to accompanying FIGS. 2–6.

Figure 1:
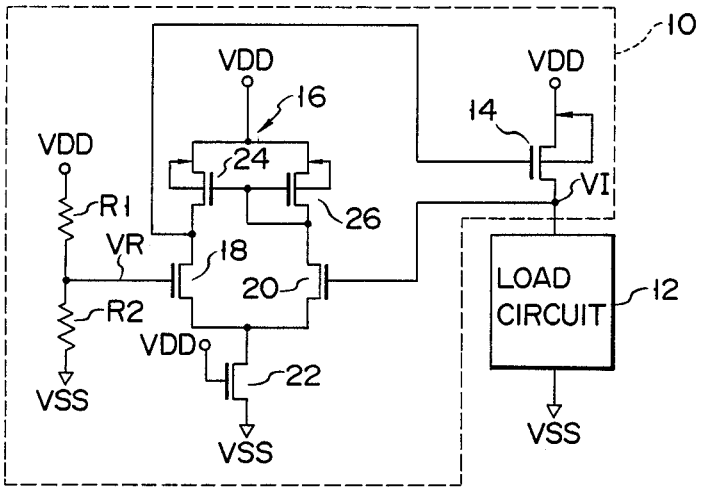
F I G. 1 (PRIOR ART)
FIG. 1 shows a conventional power voltage regulator circuit.
Figure 2:
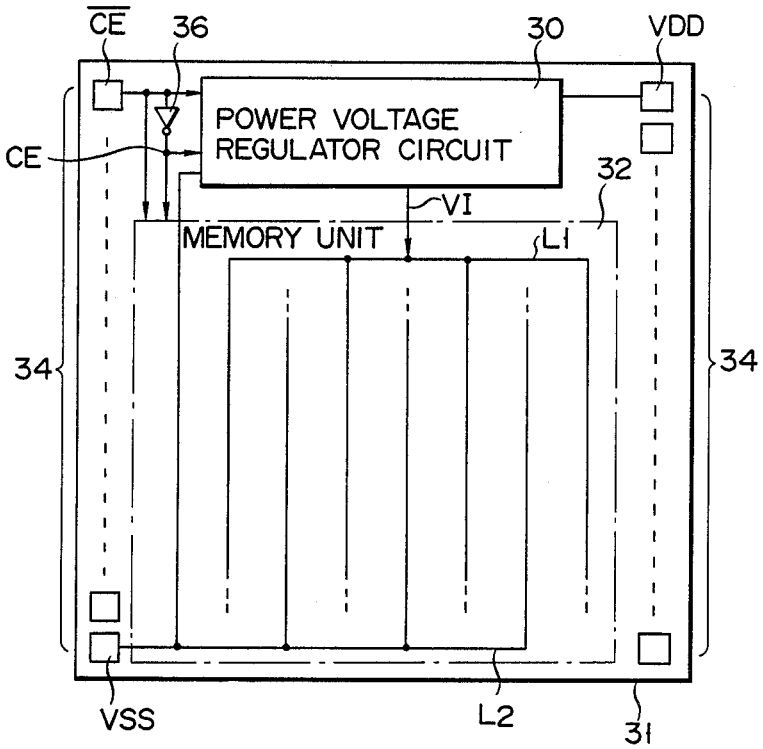
FIG. 2 is a top view of a semiconductor memory chip in which a power voltage regulator circuit according to an embodiment of the invention is formed.

FIG. 2 schematically shows the power voltage regulator circuit of the invention. Power voltage regulator circuit 30 is formed within semiconductor chip 31 along with an LSI circuit, for example, memory unit 32. Bonding pads 34 are formed on the circumference of memory chip 31, and serve as power terminals VDD and VSS, chip enable terminal $\overline{CE}$, and other input/output terminals. An external power voltage is applied to power terminal VDD. Power terminal VSS is set to the ground potential. Regulator circuit 30 is connected between power terminals VDD and VSS. Output lines L1 and L2 are connected to an output terminal of regulator circuit 30 and power terminal VSS, respectively. Memory unit 32 is connected between output lines L1 and L2. A chip enable signal is supplied from the outside to chip enable terminal $\overline{CE}$ when memory unit 32 is accessed. The potential of chip enable terminal $\overline{CE}$ is set to 0 V upon receipt of the chip enable signal, and is kept at 5 V in other state. Chip enable terminal $\overline{CE}$ is connected to regulator circuit 30 and memory unit 32, directly and through inverter 36. Other terminals are connected to memory unit 34. Memory unit 34 has a number of static memory cells each constituted by submicron MOS transistors, and a controller for selecting the memory cells and for writing/reading out data in/from the selected memory cells.

Figure 3:
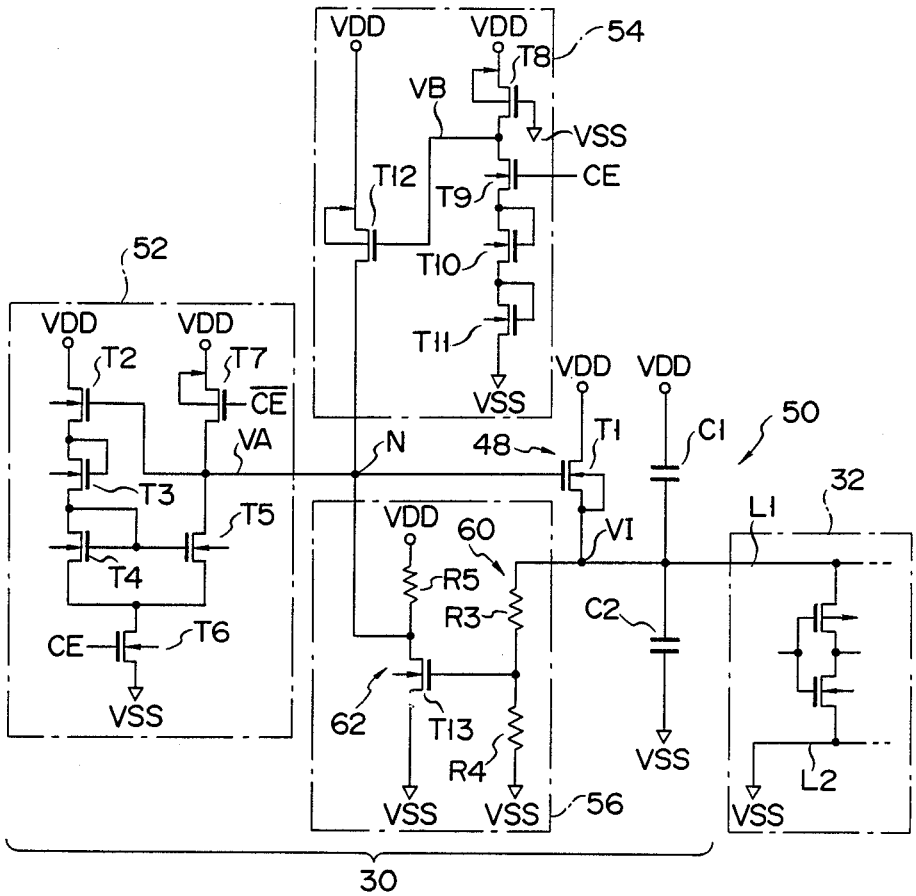
FIG. 3 shows the circuit configuration of the power voltage regulator circuit shown in FIG. 2.

FIG. 3 shows power voltage regulator circuit 30 in detail. Regulator circuit 30 includes voltage-drop section 48 and ripple filter 50 for smoothing internal power voltage VI. Voltage-drop section 48 has N-channel MOS transistor T1. The drain of MOS transistor T1 is connected to power terminal VDD. The source and back gate of MOS transistor T1 are connected to each other and to output line L1. The source of MOS transistor T1 serves as an output terminal of regulator circuit 30. Namely, a source voltage of MOS transistor T1 is fed to memory unit 32 as internal power voltage VI. Ripple filter 50 is constituted by capacitance C1 and capacitance C2. Capacitance C1 is connected between power terminal VDD and output line L1, and capacitance C2 is connected between output line L1 and power terminal VSS.

Regulator circuit 30 includes first and second constant voltage generators 52 and 54, and bias circuit 56, in order to control the gate voltage of MOS transistor T1. Constant voltage generator 52 comprises N-channel MOS transistors T2, T3, T4, T5, T6 and P-channel MOS transistor T7. The drain of MOS transistor T2 is connected to terminal VDD. The source and gate of MOS transistor T3 are connected to each other and to the source of MOS transistor T2. The source and gate of MOS transistor T4 are connected to each other and to the source of MOS transistor T3. The gate of MOS transistor T5 is connected to a junction between the drain of MOS transistor T4 and the source of MOS transistor T3. The drain of MOS transistor T5 is connected to the drain of MOS transistor T7. The source and back gate of MOS transistor T7 are connected to each other and to power terminal VDD. The gate of MOS transistor T7 is connected to chip enable terminal $\overline{CE}$, shown in FIG. 2. The drain of MOS transisor T6 is connected to the sources of MOS transistors T4 and T5. The source of MOS transistor T6 is connected to power terminal VSS. The gate of MOS transistor T6 is connected to output terminal CE of inverter 36, shown in FIG. 2. A junction between the drains of MOS transistors T5 and T7 serves as an output terminal of constant voltage generator 52 and is connected to the gates of MOS transistors T1 and T2. In constant voltage generator 52, MOS transistors T5 and T6 serve as a current mirror load, and MOS transistor T7 serves as a pull-up transistor. Constant voltage generator 52 has a low current consumption property. This property is derived from the fact that MOS transistor T2 has a gate connected to node N, MOS transistor T4 on the input side of the current mirror load is series-connected to MOS transistor T2, and an output terminal of MOS transistor T5 on the output side of the current mirror load is connected to node N.

Constant voltage generator 54 is constituted by P-channel MOS transistors T8 and T12 and N-channel MOS transistors T9, T10, and T11. The source and back gate of MOS transistor T8 are connected to each other and to power terminal VDD. The gate of MOS transistor T8 is connected to power terminal VSS. The gate of MOS transistor T9 is connected to output terminal CE of inverter 36, shown in FIG. 2. The drain of MOS transistor T9 is connected to the drain of MOS transistor T8. The gate and drain of MOS transistor T10 are connected to each other and to the source of MOS transistor 9. The gate and drain of MOS transistor T11 are connected to each other and to the source of MOS transistor T10. The source of MOS transistor T11 is connected to power terminal VSS. The gate of MOS transistor T12 is connected to a junction of the drains of MOS transistors T8 and T9. The source and back gate of MOS transistor T12 are connected to each other and to power terminal VDD. The drain of MOS transistor T12 is connected to the gate of MOS transistor T1, and serves as an output terminal of constant voltage generator 54. In constant voltage generator 54, MOS transistor T12 serves as a pull-up transistor.

Bias circuit 56 includes voltage-divider 60 and inverter 62. Voltage divider 60 comprises resistors R3 and R4 which are connected in series between output line L1 and power terminal VSS. Inverter 62 is constituted by resistor R5 and transistor T13. Resistor R5 is connected at one end to power terminal VDD and serves as a load. Transistor T13 has a gate connected to a junction between resistors R3 and R4 and a current path connected between the other end of resistor R5 and power terminal VSS. The resistance values of resistors R3, R4, and R5 are set to 8 GΩ, 2 GΩ, and 2 GΩ, respectively.

Figure 4:
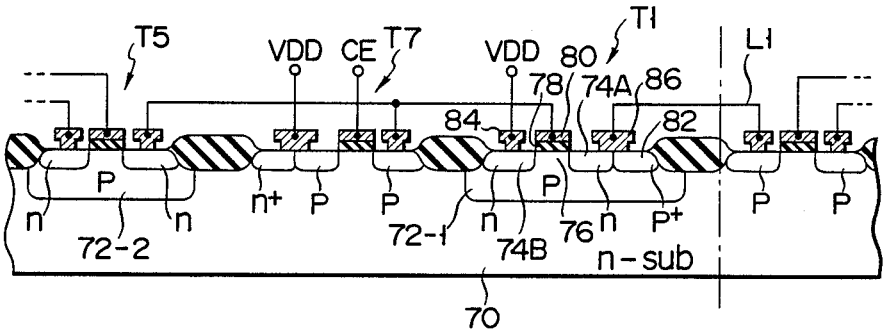
FIG. 4 shows the detailed structure of a voltage drop section in the circuit of FIG. 3.

FIG. 4 shows in detail the structure of the voltage drop section. Semiconductor chip 31 has N-type substrate 70 and P-type wells 72-1, 72-2, . . . , formed in the surface area of substrate 70. For example, N-type regions 74A and 74B are formed in the surface area of well 72-1, and serve as a source and a drain of MOS transistor T1. A region of the surface area of well 72-1, which is located between N-type regions 74A and 74B, serves as channel region 76 of the MOS transistor T1. Oxide film 78 is formed over channel region 76. Gate electrode 80 of MOS transistor T1 is formed on oxide film 78. $P^+$-type contact region 82 is formed in the surface area of well 72-1. Drain electrode 84 of MOS transistor T1 is formed on region 74B, and is connected to power terminal VDD. Source electrode 86 of MOS transistor T1 is formed on regions 74A and 82, and is connected to output line L1. Well 72-1 serves as a back gate of MOS transistor T1, and is electrically connected to source region 74A through regions 82 and 86. The potential of well 72-1 is equal to that of source region 74A.

Figure 5:
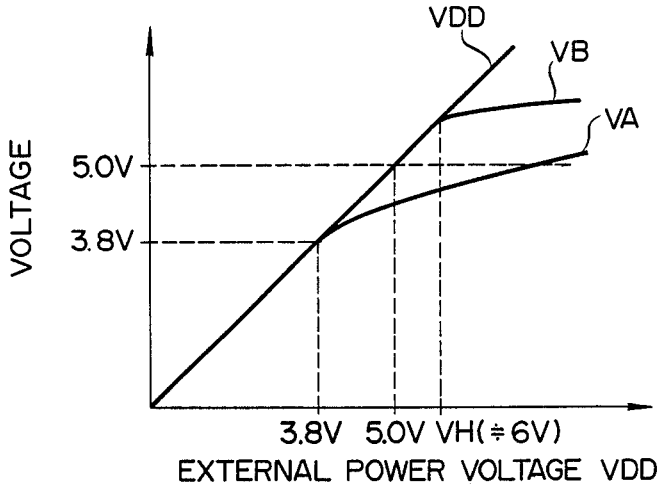
FIG. 5 is a graph for explaining the output characteristics of constant voltage generators 52 and 54 shown in FIG. 3.

FIG. 5 is a graph for explaining the output characteristics of constant voltage generators 52 and 54. The output voltages of constant voltage generators 52 and 54 are constant if external power voltage VDD is unchanged. Curve VA shows the dependency of the drain voltage of MOS transistor T7 on external power voltage VDD. Curve VB shows the dependency of the gate voltage of MOS transistor T12 on external power voltage VDD. The drain voltage (VA) of MOS transistor T7 is equal to external power voltage VDD when external power voltage VDD is fixed to a level in a range from 0 to 3.8 V. When external power voltage VDD is fixed to a level higher than 3.8 V, the drain voltage (VA) is maintained at a lower level than external power voltage VDD. The gate voltage (VB) of MOS transistor T12 is maintained at a level equal to that of external power voltage VDD when external power voltage VDD is fixed at a level in a range from 0 to 6 V. When external power voltage VDD is fixed to a level higher than 6 V, the gate voltage (VB) of MOS transistor T12 is maintained at a lower level than external power voltage VDD. Supposing that the voltage levels at which the saturation of voltages VA and VB begins are represented by VHA and VHB, VHA (=3.8 V) is lower than a standard value (=5 V) of external power voltage VDD, and VHB (=6 V) is higher than the standard value of VDD.

The operation of the above-mentioned power voltage regulator circuit will now be described. Memory unit 32 is set in the standby state when a chip enable signal is not fed to terminal CE. In the standby state, a low level voltage (=0 V) and a high level voltage (=5 V) are supplied to the gates of MOS transistors T6 and T7 of constant voltage generator 52, respectively. MOS transistors T6 and T7 are, then, turned off, thereby setting the power consumption of voltage generator 52 to zero. Voltage generator 52 is kept in a non-operating state. Similarly, when memory unit 32 is in the standby state, the gate of MOS transistor T9 of voltage generator 54 receives a low level voltage (=0 V). MOS transistor T9 is turned off, thereby keeping voltage generator 54 in a non-operating state. Irrespective of the state of memory unit 32, bias circuit 56 is kept in an operating state. Memory unit 32 is not accessed in the standby state. At this time, the conductivity of MOS transistor T1 is controlled under the output voltage of bias circuit 56, and sets internal power voltage VI to a predetermined level, for example, to 4 V, during the period in which memory unit 32 is not accessed.

Memory unit 32 is set in an active state when a chip enable signal is supplied to terminal $\overline{CE}$. In the active state, a high level voltage (=5 V) and a low level voltage (=0 V) are supplied to the gates of MOS transistors T6 and T7 of constant voltage generator 52, respectively, and a high level voltage (=5 V) is supplied to the gate of MO transistor T9 of voltage generator 54. MOS transistors T6 and T7 are, then, turned on, thereby setting voltage generator 52 in the operating state. MOS transistor T9 is turned on, thereby setting voltage generator 54 in the operating state.

Figure 6:
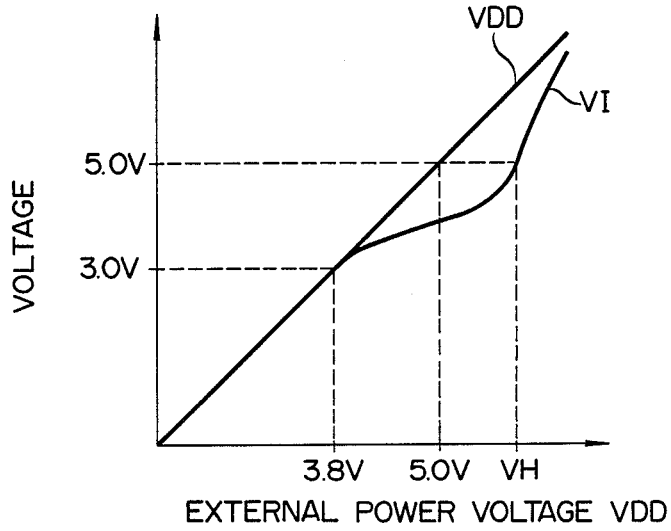
FIG. 6 is a graph for explaining the operation of the power voltage regulator circuit shown in FIG. 2, and showing the relationship between the internal power voltage and the external power voltage.

FIG. 6 shows the relationship between internal power voltage VI and external power voltage VDD. When external power voltage VDD is equal to or lower than VHB (=6 V), MOS transistor T12 of voltage generator 54 receives gate voltage VB which is equal to external power voltage VDD, so that MOS transistor T12 is turned off. At this time, the potential of node N is equalized to output voltage VA of constant voltage generator 52, and is utilized as a gate voltage for MOS transistor T1. When voltage VA is within the range from 3.8 V to VHB (=6 V), internal power voltage VI is made lower than output voltage VA by a an amount corresponding to threshold voltage of MOS transistor T1. The back gate, or well 72-1, of MOS transistor T1 is not connected to substrate 70, but to region 74 serving as a source. Thus, the threshold voltage of MOS transistor T1 is kept constant without being affected by the back gate bias effect.

In the life testing time, external power voltage VDD is set at a higher level than VHB, for example, 7 V. The life testing is performed during the manufacturing step or at the time of delivery, in order to test the life of products selected at random. When external power voltage VDD is set at a higher level than VHB, MOS transistor T12 of constant voltage generator 54 receives gate voltage VB which is lower than external power voltage VDD, so that MOS transistor T12 is turned on. Thus, the potential of node N is set higher than output voltage VA of constant voltage generator 52. Internal power voltage VI is set at a level lower than the potential of node N by an amount corresponding to a threshold voltage of MOS transistor T1.

In the above embodiment, N-channel MOS transistor T1 is provided in voltage drop section 48, and the drain and source of MOS transistor T1 are connected to power terminal VDD and output line L1, respectively. The back gate of MOS transistor T1 is connected to the source thereof, and is set to a potential of output line L1. When the potential of output line L1 is lowered due to increase in a load current the potential of the back gate varies in accordance with the potential decrease in output line L1, thus increasing the conductivity of the MOS transistor. As a result, a potential change in output line L1 is automatically curbed, and no current mirror type differential amplifier needs to be used in order to control the voltage drop section.

The power voltage regulator circuit is controlled by a chip enable signal. Constant voltage generators 52 and 54 are turned off when memory unit 32 is in the standby state. At this time, bias circuit 56 supplies a gate voltage to MOS transistor T1. Since the resistance values of resistors R3, R4, and R5 of bias circuit 56 are sufficiently high, bias circuit 56 consumes a very small amount of current, for example, several tens of nA. When memory unit 32 is in the active state, constant voltage generators 52 and 54 are rendered operative. Constant voltage generator 54 is used only when internal power voltage VI needs to be increased for life testing. When external power voltage VDD is set to a standard level (=5 V) which is lower than VHB, constant voltage generator 52 controls the gate voltage of MOS transistor T1. Constant voltage generator 52 consumes the current of several tens of $\mu$A. In this embodiment, a current consumption can be sufficiently reduced, compared to a current mirror type differential amplifier which consumes the current of several mA.

In the above embodiment, constant voltage generators 52 and 54 and bias circuit 56 may be modified if the basic functions of these devices are unchanged. Even if modifications are made, a current consumption can be reduced, as in the above embodiment.

Bias circuit 56 and constant voltage generator 54 may not be provided in the voltage regulator circuit. Constant voltage generator 52 may be constituted such that it constantly generates a constant voltage without being controlled by a chip enable signal.

In the present invention, a control circuit, whose power consumption is low, compared to a current mirror type differential amplifier, can be used to control the gate voltage of the MOS transistor of the voltage drop section. Therefore, the power consumption of an LSI device including a power voltage regulator circuit can be reduced. The power voltage regulator circuit of this invention is suitable for an LSI device such as a SRAM. The present invention can easily satisfy the requirements concerning the power consumption of an LSI device, which are difficult to meet in the prior art.

What is claimed is:

1. A power voltage regulator circuit comprising:

a power terminal for receiving an external power voltage;

an output line;

an n-channel MIS transistor serving as voltage-drop means for lowering the external power voltage, and having a drain connected to said power terminal and a source connected to said output line, and a gate;

a semiconductor body electrically connected to the source of said MIS transistor, and whose surface region serves as a channel of said MIS transistor; and a first constant voltage generator, connected to said power terminal, for generating an output voltage lower than said external power voltage when said external power voltage is higher than a first predetermined level, and for supplying the generated output voltage to the gate of said MIS transistor;

wherein said first constant voltage generator includes an output node connected to the gate of said MIS transistor, a pull-up means connected between said power terminal and the output node, a variable resistor means connected at one end to said power terminal for supplying a current in accordance with the potential of said output node, a load circuit of a current mirror type having an input load connected to the outer end of said variable resistor means, and an output load connected to the output node.

2. A power voltage regulator circuit according to claim 1, further comprising a bias circuit for supplying a stand-by bias voltage to the gate of said n-channel MIS transistor of the voltage-drop means.

3. A power voltage regulator circuit according to claim 1, wherein said output line is connected to an integrated circuit serving as a load, and said constant voltage generator is responsive to a chip-enable signal which is supplied when said integrated circuit is made active.

4. A power voltage regulator circuit according to claim 3, wherein said variable resistor means includes an n-channel MIS transistor, said load circuit includes a pair of first and second n-channel MIS transistors, as said input and output loads, and a third n-channel MIS transistor, and said pull-up means includes a p-channel MIS transistor.

5. A power voltage regulator circuit according to claim 4, wherein the n-channel MIS transistor of said variable resistor means has a gate connected to said output node and a drain connected to said power terminal, the first n-channel MIS transistor of said load circuit has a drain connected to receive a drain current from the MIS transistor of said variable resistor means and a gate connected to the drain thereof, the second n-channel MIS transistor of said load circuit has a drain connected to said output node, and a gate connected to the drain of said first n-channel MIS transistor, the third n-channel MIS transistor of said load circuit has a current path connected at one end to the sources of said first and second n-channel MIS transistors and grounded at the other end, and a gate connected to receive a chip-enable signal, and the p-channel MIS transistor of said pull-up means has a current path connected between said power terminal and output node, and a gate connected to receive an inversion signal of said chip-enable signal.

6. A power voltage regulator circuit according to claim 1, further comprising a second constant voltage generator, for generating an output voltage higher than the output voltage of said first constant voltage generator when the external power voltage is higher than a second predetermined level, said second predetermined level being higher than said first predetermined level and a standard level of said external power voltage, and for supplying the higher generated output voltage to the gate of said MIS transistor.

7. A power voltage regulator circuit comprising:

a power terminal for receiving an external power voltage;

an output line;

an n-channel MIS transistor serving as voltage-drop means for lowering the external power voltage, and having a drain connected to said power terminal and a source connected to said output line, and a gate;

a semiconductor body electrically connected to the source of said MIS transistor, and whose surface region serves as a channel of said MIS transistor;

a first constant voltage generator, connected to said power terminal, for generating an output voltage lower than said external power voltage when said external power voltage is higher than a first predetermined level, and for supplying the generated output voltage to the gate of said MIS transistor; and a second constant voltage generator, for generating an output voltage higher than the output voltage of said first constant voltage generator when the external power voltage is higher than a second predetermined level, said second predetermined level being higher than said first predetermined level and a standard level of said external power voltage, and for supplying the higher generated output voltage to the gate of said MIS transistor;

wherein said second constant voltage generator includes an output node connected to the gate of said MIS transistor of said voltage-drop means, a pull-up means connected between said power terminal and the output node of the second constant voltage generator, and a driver for driving and pull-up means of said second constant voltage generator, in accordance with said external power voltage.

8. A power voltage regulator circuit according to claim 7, wherein said pull-up means of the second constant voltage generator is a p-channel MIS transistor having a source connected to said power terminal, a drain connected to the output node of the second constant voltage generator, and a gate, said driver includes a p-channel MIS transistor and a plurality of n-channel MIS transistors, said p-channel MIS transistor of the driver has a gate grounded, a drain connected to said power terminal, and a source connected to the gate of said p-channel MIS transistor of the pull-up means of said second constant voltage generator, and said n-channel MIS transistors of the driver have current paths connected in series between the source of said p-channel MIS transistor of the driver and ground.

9. A power voltage regulator circuit according to claim 7, further comprising a bias circuit for supplying a stand-by bias voltage to the gate of said second n-channel MIS transistor of the voltage-drop means.

10. A power voltage regulator circuit comprising:

a power terminal for receiving an external power voltage;

an output line;

an n-channel MIS transistor serving as voltage-drop means for lowering the external power voltage, and having a drain connected to said power terminal and a source connected to said output line, and a gate;

a semiconductor body electrically connected to the source of said MIS transistor, and whose surface region serves as a channel of said MIS transistor; and a first constant voltage generator, connected to said power terminal, for generating an output voltage lower than said external power voltage when said external power voltage is a higher than a first predetermined level, and for supplying the generated output voltage to the gate of said MIS transistor.

11. A power voltage regulator circuit according to claim 10, further comprising a second constant voltage generator, for generating an output voltage higher than the output voltage of said first constant voltage generator when the external power voltage is higher than a second predetermined level, said second predetermined level being higher than said first predetermined level and a standard level of said external power voltage, and for supplying the higher generated output voltage to the gate of said MIS transistor.

12. A power voltage regulator circuit according to claim 10, further comprising a bias circuit for supplying a stand-by bias voltage to the gate of said n-channel MIS transistor of the voltage-drop means.

13. A power voltage regulator circuit according to claim 12, wherein said bias circuit includes series-connected resistive elements for dividing the potential of the output line, and an inverter responsive to the output voltage of said resistive elements, for generating an output voltage as said stand-by bias voltage.

* * * * *